US005509481A

United States Patent [19]

Huber et al.

[11] Patent Number: 5,509,481

[45] **Date of Patent: *Apr. 23, 1996**

[54] METHOD OF PERFORATING INCLUDING AN AUTOMATIC RELEASE APPARATUS SUSPENDING BY WIRELINE OR COILED TUBING IN A WELLBORE FOR PERFORATING A LONG LENGTH INTERVAL OF THE WELLBORE IN A SINGLE RUN USING A GUN STRING LONGER THAN A WELLHEAD LUBRICATOR

[75] Inventors: Klaus B. Huber; Joe C. Hromas, both of Sugarland, Tex.

[ * ] Notice: The term of this patent shall not extend beyond the expiration date of Pat. No. 5,293,940.

[73] Assignee: Schlumberger Technology Corporation, Houston, Tex.

[21] Appl. No.: 270,949

[22] Filed: Jul. 5, 1994

Related U.S. Application Data

[63] Continuation-in-part of Ser. No. 220,983, Mar. 30, 1994, Pat. No. 5,429,192, which is a continuation-in-part of Ser. No. 57,948, May 5, 1993, Pat. No. 5,366,013, which is a continuation-in-part of Ser. No. 955,816, Oct. 2, 1992, Pat. No. 5,318,126, which is a continuation of Ser. No. 858,400, Mar. 26, 1992, abandoned.

[51] Int. Cl.[6] ..... E21B 43/116

[52] U.S. Cl. ..... 166/297; 166/55.1; 166/377

[58] Field of Search ..... 166/297, 55.1, 166/377, 63, 376

[56] References Cited

U.S. PATENT DOCUMENTS

| | | | |
|---|---|---|---|
| 4,515,217 | 5/1985 | Stout | 166/297 |
| 4,526,233 | 7/1985 | Stout | 166/377 |
| 4,682,657 | 7/1987 | Crawford | 166/385 |
| 4,756,363 | 7/1988 | Lammon, II et al. | 166/55.1 |
| 4,765,409 | 8/1988 | McClure et al. | 166/297 |
| 4,771,827 | 9/1988 | Barker et al. | 166/55.1 |
| 4,776,393 | 10/1988 | Forehand et al. | 166/55.1 |
| 4,905,759 | 3/1990 | Wesson et al. | 166/55 |
| 4,940,095 | 7/1990 | Newman | 166/378 |
| 5,025,861 | 6/1991 | Huber et al. | 166/297 |
| 5,131,470 | 7/1992 | Miszewski et al. | 166/297 |
| 5,293,940 | 3/1994 | Hromas et al. | 166/297 |
| 5,318,126 | 6/1994 | Edwards et al. | 166/297 |
| 5,353,875 | 10/1994 | Schultz et al. | 166/297 |

*Primary Examiner*—Hoang C. Dang
*Attorney, Agent, or Firm*—John H. Bouchard

[57] ABSTRACT

A new perforating method and release apparatus enables a wellbore operator to perforate long length intervals of a wellbore during a single perforating run into the wellbore, the interval of the wellbore being perforated being longer in length than the length of a wellhead lubricator. The new perforating method includes the step of suspending a perforating gun suing from a conveyor in a wellbore. The gun string includes a detonating cord and a novel automatic release apparatus interconnected between a first part of the gun string and a second part of the gun suing which includes a perforating gun. The automatic release apparatus includes a frangible member which will shatter in response to a detonation wave propagating in the detonating cord thereby initiating the release of the second part of the gun swing from the first part of the gun suing. The initiation of such release takes place before the perforating gun detonates. When the perforating gun detonates, the second part of the gun string falls to a bottom of the wellbore and the first part of the gun suing is raised to a surface of the wellbore. The detonation of the perforating gun will not shock and break the conveyor.

12 Claims, 5 Drawing Sheets

FIG. 6
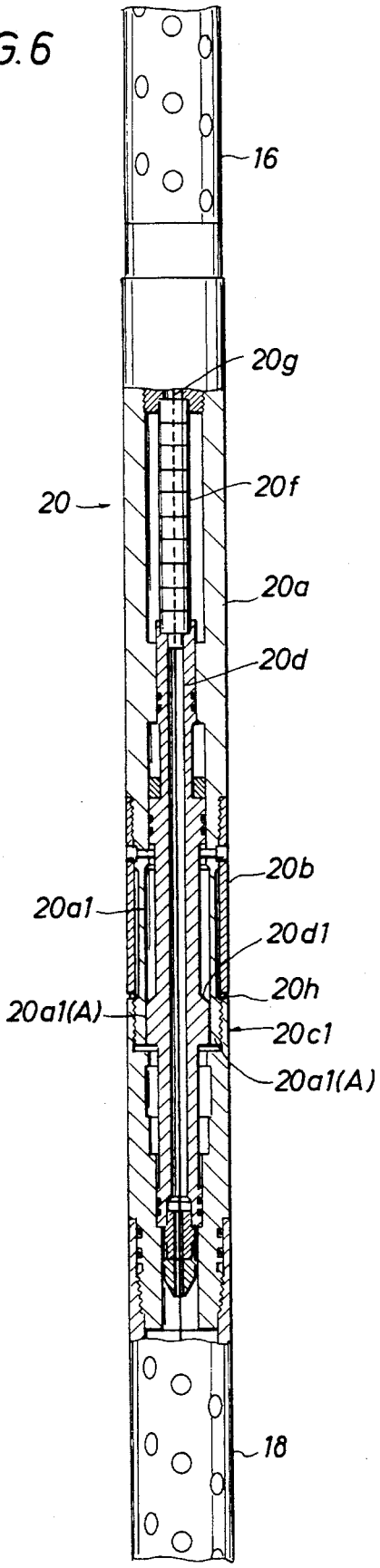
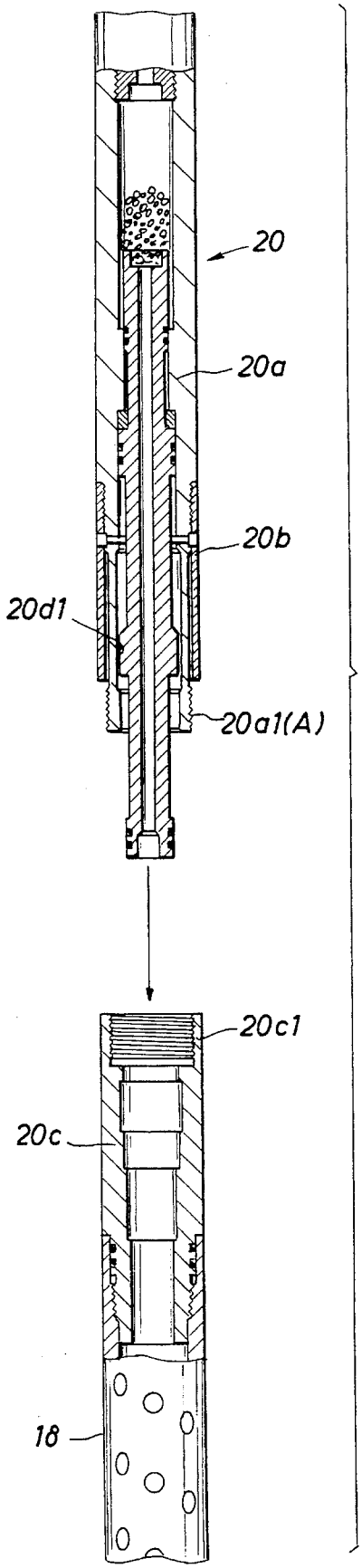
FIG. 7

METHOD OF PERFORATING INCLUDING AN AUTOMATIC RELEASE APPARATUS SUSPENDING BY WIRELINE OR COILED TUBING IN A WELLBORE FOR PERFORATING A LONG LENGTH INTERVAL OF THE WELLBORE IN A SINGLE RUN USING A GUN STRING LONGER THAN A WELLHEAD LUBRICATOR

CROSS REFERENCE TO RELATED APPLICATIONS

This application is a continuation in part of a first application Ser. No. 08/220,983 filed Mar. 30, 1994, now U.S. Pat. No. 5,429,192 which is a continuation in part of a second application Ser. No. 08/057,948 filed May 5, 1993, now U.S. Pat. No. 5,366,013 which is a continuation in part of a third application Ser. No. 07/955,816 filed Oct. 2, 1992, now U.S. Pat. No. 5,318,126 which is a continuation of a fourth application Ser. No. 07/858,400 filed Mar. 26, 1992 which was abandoned and became Ser. No. 08/032,817 filed Mar. 16, 1993, now U.S. Pat. No. 5,293,940.

BACKGROUND OF THE INVENTION

The subject matter of the present invention relates to a novel method of perforating a formation traversed by a wellbore in a single run using a long perforating gun string that is longer than a wellhead lubricator, where the long gun string used in connection with the aforementioned novel method of perforating includes an automatic release apparatus which is adapted to be connected between adjacent perforating guns of the long gun string or between a firing head and a perforating gun of the long gun string, the automatic release apparatus automatically separating into a first top piece and a second bottom piece in response to a detonation wave propagating through the release apparatus, initiation of the automatic separation taking place before the perforating guns of the long gun string detonate, the perforating guns of the long gun string located below the second bottom piece of the automatic release apparatus falling to a bottom of the wellbore when the automatic release apparatus separates into the two pieces and the perforating gun connected to the second bottom piece of the release apparatus detonates.

In application Ser. No. 08/032,817 filed Mar. 16, 1993, now U.S. Pat. No. 5,293,940 which is a continuation of application Ser. No. 07/858,400 filed Mar. 26, 1992 abandoned, an automatic tubing release apparatus adapted to be disposed in a wellbore includes a frangible member and enclosed detonating cord. The frangible member shatters when a detonation wave, propagating in the detonating cord, passes through the frangible member. Before the frangible member shatters, a perforating apparatus is connected to an interior of a tubing. However, when the frangible member shatters, the perforating apparatus is automatically released from the interior of the tubing and the perforating apparatus falls to a bottom of the wellbore.

In application Ser. No. 07/955,816 filed Oct. 2, 1992, now U.S. Pat. No. 5,318,126 which is a contination of the aforementioned application Ser. No. 07/858,400 filed Mar. 26, 1992 which was abandoned and became Ser. No. 08/032,817 filed Mar. 16, 1993, now U.S. Pat. No. 5,293,940 an explosively opened production valve adapted to be disposed in a wellbore includes the same frangible member with enclosed detonating cord adapted to conduct a detonation wave. The production valve is initially disposed in one state (e.g, a closed state). However, when the frangible member shatters in response to the detonation wave, conducting in the detonating cord, passing through the frangible member, the production valve changes from the one state to another state (e.g., an open state).

In application Ser. No. 08/057,948 filed May 5, 1993, now U.S. Pat. No. 5,366,013 which is a contination in part of the aforementioned application Ser. No. 07/955,816 filed Oct. 2, 1992, now U.S. Pat. No. 5,318,126, a shock absorber adapted to be disposed in a wellbore includes the same frangible member with enclosed detonating cord adapted to conduct a detonation wave. The shock absorber initially cannot absorb shock. However, when the frangible member shatters in response to the detonation wave passing through the frangible member, the shock absorber is then ready to absorb shock.

In application Ser. No. 08/220,983 filed Mar. 30, 1994, which is a continuation in part of the aformentioned application Ser. No. 08/057,948 filed May 5, 1993, now U.S. Pat. No. 5,366,013 a wellbore tool includes a means for expanding an anchor slip which grips a wellbore casing and a primary anchor release mechanism for automatically releasing the anchor slip when the same frangible member shatters in response to a detonation wave propagating in a detonating cord.

In all of the aforementioned applications, a detonating cord is enclosed by a frangible member. When a detonation wave propagates within the detonating cord, the detonation wave passes through the interior of the frangible member. In response to the detonation wave, the frangible member shatters. When the frangible member shatters, an event occurs.

It is common practice to perforate wellbores by using a perforating gun which suspends by a wireline in the wellbore. However, for a single run in the wellbore, the weight of the perforating gun is a function of and limits the length of the perforating gun string due to the breaking strength of the wireline. That is, for a single run in the wellbore, when a perforating gun string suspends by wireline in a wellbore, if the length of the perforating gun string is longer than a wellhead pressure lubricator, when the perforating gun detonates, the shock of the perforating gun will sometimes snap and break the wireline. Therefore, in order to avoid this problem, when a long length interval in the wellbore (i.e., longer than a wellhead pressure lubricator) must be perforated, several separate wireline perforating runs in the wellbore was required. For example, after a first zone in the wellbore was perforated, the well became pressurized. The old wireline perforating gun string section was removed in order to attach the next new perforating gun string section. The old wireline perforating gun string section was raised into a wellhead pressure lubricator (sometimes called a riser) and a valve below the lubricator was closed. Pressure was bled from the lubricator, the lubricator was detached, the next perforating gun string section was attached to the wireline, and a wellhead pressure lubricator was reattached to the wellhead. The valve was then opened and the new wireline perforating gun string section was run back into the wellbore, under pressure, in order to perforate a second zone in the wellbore.

However, it is expensive and time consuming to perforate a long length interval of a wellbore (i.e., an interval in the wellbore which is longer than a wellhead lubricator) by performing the aforementioned several separate wireline perforating runs in the wellbore. It would be more convenient, less time consuming, and less expensive to perforate the long length interval in the wellbore during a single run in the wellbore while maintaining underbalance, without resorting to the several separate wireline perforating runs, without breaking or snapping the wireline, and without killing the well.

This can be accomplished by using a novel perforating method and, during the practice of the novel perforating method, by using a perforating gun string that includes a novel automatic release apparatus. The automatic release apparatus would initiate disconnection of a first part of a long perforating gun string (a gun string which is longer than the wellhead lubricator) from a second part of the gun string, which includes a perforating gun, immediately before detonating the perforating gun of the second part. This would reduce the shock of the long gun string on the wireline. This reduction of the shock of the gun string on the wireline would prevent the gun string from snapping and breaking the wireline. As a result, by using the novel perforating method and the novel automatic release apparatus of the present invention, one can perforate a long length interval in the wellbore during a single run into the wellbore by using a long perforating gun string which is longer than the wellhead lubricator without snapping and breaking the wireline while maintaining underbalance and without killing the well; it would not be necessary to practice the old, more expensive method of performing several separate wireline perforating runs into the wellbore.

U.S. Pat. No. 5,293,940 to Hromas et al discloses an Automatic Tubing Release apparatus. However, this apparatus is adapted to be connected between a perforating gun and a tubing string and includes a collet finger which is attached to an internal surface of a fill sub which is connected to the tubing string. A release of the collet finger from the internal surface of the fill sub releases the perforating gun from the tubing string. However, this automatic release apparatus, by design, must be connected between the perforating gun and the tubing string. It cannot be connected between adjacent perforating guns of a long perforating gun string run on wireline. Therefore, the release apparatus of the above Hromas et al patent cannot be used in connection with a long wireline perforating gun string for perforating long length intervals in a wellbore in a single perforating run. Another new automatic release apparatus design is needed.

SUMMARY OF THE INVENTION

It is a primary object of the present invention to provide a new perforating method for perforating long length intervals of a wellbore during a single perforating run into the wellbore when the perforating gun string is longer in length than a length of a wellhead pressure lubricator while maintaining underbalance and without killing the well.

It is a further object of the present invention to provide a new automatic release apparatus for use in conjunction with the new perforating method which is adapted to be connected between a first part and a second part of a perforating gun string and which will automatically separate into two pieces in response to a detonation wave passing therethrough thereby releasing the second part from the first part of the perforating gun string.

It is a further object of the present invention to provide the aforementioned new automatic release apparatus where the release apparatus includes a frangible member having a hollow interior and a detonating cord disposed within the hollow interior of the frangible member, the frangible member shattering in response to a detonation wave conducting in the detonating cord passing through the hollow interior of the frangible member, the release apparatus automatically separating into the two pieces and releasing the second part from the first part of the perforating gun string when the frangible member shatters.

It is a further object of the present invention to provide a new perforating method for perforating long length intervals of a wellbore during a single perforating run in the wellbore when the perforating gun string is longer in length than a length of a wellhead lubricator, the new perforating method including the step of suspending a gun string from either a wireline, a coiled tubing, a slickline, a braided line, an electric wireline disposed inside a coiled tubing, or other conveyor in a wellbore, the gun string being longer in length than a length of a wellhead pressure lubricator and including a first part, an automatic release apparatus, a second part which usually consists of a perforating gun that is adapted to detonate, and a detonating cord adapted for conducting a detonation wave disposed within the first part when the first part is a perforating gun, the automatic release, and the second part, the release apparatus initiating releasing of the first part from the second part of the gun string in response to the detonation wave in the detonating cord immediately before the perforating gun of the second part of the gun string detonates, the second part of the gun string falling to a bottom of the wellbore after the perforating gun of the second part detonates, the first part being retrieved to a surface of the wellbore.

It is a further object of the present invention to provide a new perforating method for perforating long length intervals of a wellbore during a single perforating run in the wellbore, where the new method includes the steps of lowering a perforating gun string, which is longer in length than a wellhead lubricator, into the wellbore, the gun string being adapted to detonate and including a first part, a second part adapted to detonate, a release apparatus disposed between the first part and the second part, and a detonating cord disposed within the release apparatus and the second part; propagating a detonation wave down the detonating cord; in response to the detonation wave, before detonating the second part of the gun string, initiating the release of the second part of the gun string from the first part of the gun string; immediately following the initiation of the release of the second part from the first part of the gun string but before the second part of the gun string has a chance to drop to a bottom of the wellbore, detonating the second part of the gun string; dropping the second part to a bottom of the wellbore; and retrieving the first part of the gun string to a surface of the wellbore.

It is a further object of the present invention to provide a new automatic release apparatus adapted to be connected between a first part and a second part of a perforating gun string in a wellbore for use in connection with the aforementioned new perforating method, where the new release apparatus comprises an outer housing including a first outer housing and a second outer housing, a frangible member disposed within the outer housing, a detonating cord disposed within an interior of the frangible member, a piston having an upset and disposed within the outer housing and supported by the frangible member, and a collet finger connected to the first outer housing and disposed between the upset on the piston and an internal surface of the second outer housing, a detonation wave propagating in the detonating cord shattering the frangible member, the piston moving in response to wellbore fluid pressure when the frangible member shatters, the upset moving when the piston moves, the collet finger collapsing and disconnecting from the internal surface of the second outer housing, and the second part of the gun string releasing from the first part of the gun string.

In accordance with these and other objects of the present invention, a new method of perforating long length intervals of a wellbore during a single run into the wellbore and a new automatic release apparatus for use in connection with the new perforating method is disclosed. In accordance with the new perforating method, a perforating gun string is lowered into a wellbore. The gun string suspends from either a wireline, a coiled tubing, a slickline, a braided line, an electric wireline disposed inside a coiled tubing, or other conveyor. The perforating gun string includes a first part (which may include either a firing head or a first perforating gun), a second part (which usually comprises a second perforating gun), and a novel automatic release apparatus interconnected between the first part and the second part. The automatic release apparatus includes a frangible member made of a cast iron material and having a hollow interior. A detonating cord is disposed within: the first part of the gun string when the first part is a perforating gun, the hollow interior of the frangible member of the automatic release apparatus, and the second part of the gun string. The gun string is longer in length than a length of a wellhead pressure lubricator. As a result, since the gun string length is longer than the length of the wellhead lubricator, the gun string will now perforate a "long length interval" of the wellbore during a single run into the wellbore. A detonation wave begins to propagate within the detonating cord. When the detonation wave propagates within the hollow interior of the frangible member of the release apparatus, the frangible member shatters. At this point, when the frangible member shatters, the release apparatus initiates the release of the second part of the gun string from the first part of the gun string. However, before the second part of the gun string has a chance to fall to a bottom of the wellbore, the perforating gun of the second part of the gun string detonates (and the perforating gun of the first part of the gun string also detonates when the first part comprises a perforating gun). Since the perforating gun of the second part of the gun string is no longer physically connected to the first part, the detonation of the first part of the gun string will not shock or break the wireline conveyor. When the second part of the gun string detonates, it will now fall to a bottom of the wellbore. The first part of the gun string can be retrieved from the wellbore to a surface of the wellbore.

The novel automatic release apparatus includes an outer housing, and the outer housing includes a first outer housing and a second outer housing. The release apparatus further includes a frangible member disposed within the outer housing, the detonating cord being disposed within an interior of the frangible member, a piston having an upset and disposed within the outer housing and supported by the frangible member, and a collet finger connected to the first outer housing and disposed between the upset on the piston and an internal surface of the second outer housing. A detonation wave propagating in the detonating cord shatters the frangible member. When the frangible member shatters, the piston moves in response to wellbore fluid pressure. The upset on the piston moves when the piston moves and, as a result, the collet finger collapses and disconnects from the internal surface of the second outer housing. As a result, the second part of the gun string releases from the first part of the gun string.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 6–7 illustrate the novel automatic release apparatus of FIGS. 3–5 depicting the functional operation of the automatic release apparatus.

DETAILED DESCRIPTION OF THE PREFERRED EMBODIMENT

Figure 1:
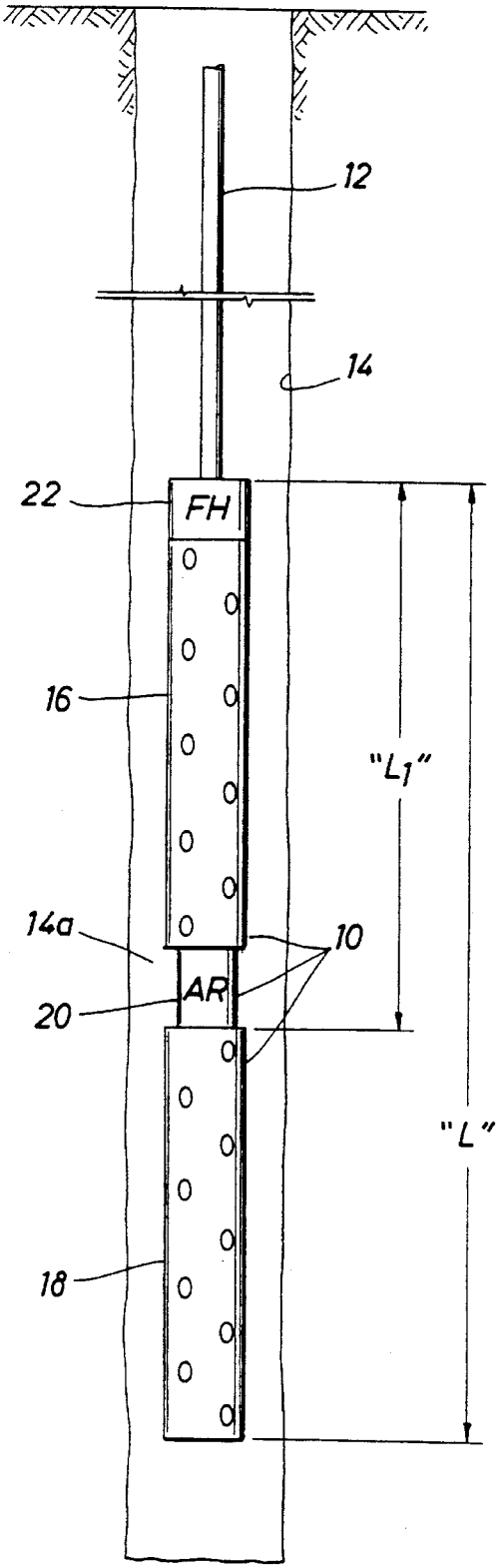
FIGS. 1 through 2 illustrate various embodiments of a perforating gun string suspending by wireline or other conveyor and disposed in a wellbore including a first part of the gun string, a second part of the gun string, and a novel automatic release apparatus interconnected between the first part and the second part for practicing the novel method of perforating long length intervals of the wellbore in a single run into the wellbore.
Figure 2:
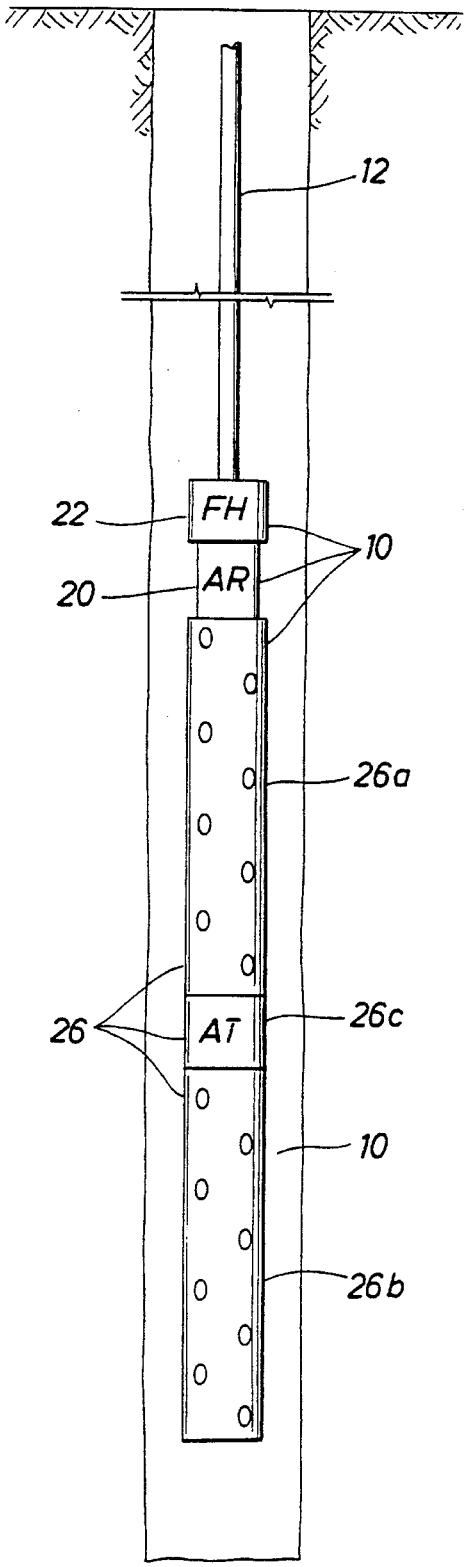

Referring to FIGS. 1–2, various embodiments of a perforating gun string suspending by wireline or other such conveyor in a wellbore are illustrated.

In FIG. 1, a first embodiment of the perforating gun string suspending by wireline or other conveyor is illustrated. In FIG. 1, a perforating gun string 10 suspends by a conveyor 12 in a wellbore 14. The conveyor 12 is connected to the gun string 10 via a cable head. The conveyor 12 could include either a wireline, a coiled tubing, a slickline, a braided line, an electric wireline disposed within a coiled tubing, or other such conveyor. The gun string 10 includes a first part 16 consisting of a first perforating gun, a second part 18 consisting of a second perforating gun, and an automatic release apparatus (AR) 20, in accordance with one aspect of the present invention, interconnected between the first part 16 and the second part 18 of the gun string 10. The first part 16 of the gun string 10 includes a firing head (FH) 22. When the conveyor 12 is a coiled tubing, the firing head 22 would be a coiled tubing firing head similar to the coiled tubing firing head disclosed in prior pending application corresponding to attorney docket number 22.1169, filed Jun. 7, 1994, to Huber et al, entitled "A Firing Head Connected Between a Coiled Tubing and a Perforating Gun Adapted to Move Freely within a Tubing String and Actuated by Fluid Pressure in the Coiled Tubing". When the conveyor 12 is an electric wireline (e.g., disposed within a coiled tubing), the firing head 22 would be an exploding foil initiator (EFI) firing head of the type disclosed in prior pending application Ser. No. 08/116,082, filed Sep. 1, 1993, now U.S. Pat. No. 5,347,929 to Lerche et al, entitled "Firing System For a Perforating Gun Including an Exploding Foil Initiator and an Outer Housing for Conducting Wireline Current and EFI Current".

In FIG. 2, a second embodiment of the perforating gun string suspending by wireline, coiled tubing, or other conveyor is illustrated. In FIG. 2, the conveyor 12 is connected to the perforating gun string 10 via the cable head, as shown in FIG. 1; however, in FIG. 2, the gun string 10 includes a first part 22 of the gun string which consists of the firing head 22, a second part 26 of the gun string, and the automatic release apparatus 20 of FIG. 1 interconnected between the first part/firing head 22 and the second part 26 of the gun string 10.

A major object of the present invention involves the perforation of a long length interval in a wellbore during a single run into the wellbore. The term "long length interval" is defined to be a length which is greater than a length of a wellhead pressure lubricator situated at a surface of the wellbore. Previously, perforation of such long length intervals of a wellbore was not possible during a single run into the wellbore. In the prior art, if a perforating gun string was lowered into a wellbore via wireline, and the gun string was "too long" (i.e., the gun string was longer than the length of a wellhead pressure lubricator), when the perforating guns detonated, the weight of the guns combined with the detonation shock of the perforating guns could snap and break the wireline. Therefore, in the prior art, one could not perforate such long length intervals of a wellbore during a single run into the wellbore. Rather, in order to perforate such long length intervals in the wellbore, several separate runs into the wellbore was required, as noted in the Background section of this application.

However, in accordance with the present invention, by using a novel method of perforating discussed below and by using the aforementioned novel automatic release apparatus 20 of FIGS. 1 through 2 above in conjunction with the novel method of perforating, the applicant has discovered a novel method and apparatus for perforating long length intervals of a wellbore during a single run into the wellbore. By using the aforementioned novel method of perforating and the aforementioned novel automatic release apparatus, it is no longer necessary to perform several separate perforating runs into the wellbore in order to perforate a long length interval in the wellbore.

The novel method of perforating long length intervals of a wellbore during a single run into the wellbore, in accordance with one aspect of the present invention, is discussed in the following paragraphs with reference (by example) to FIG. 1. However, the following novel method of perforating may also be practiced in association with FIG. 2.

Referring by example to FIG. 1, assume that the gun string 10 is lowered by a wireline conveyor 12 into the wellbore 14, although, as noted earlier, the conveyor 12 could include something other than a wireline, such as a coiled tubing, a slickline, a braided line, or an electric wireline disposed inside a coiled tubing. A detonating cord is disposed within the the first part 16 of the gun string (only because, in FIG. 1, the first part 16 is a perforating gun), within the automatic release apparatus 20, and within the perforating gun 18 of the second part 18. The gun string 10 of FIG. 1 is adapted to perforate a "long length interval" in the wellbore, that is, it is adapted to perforate a length interval "L" of the wellbore 14, as shown in FIG. 1, which is longer than the length of a wellhead pressure lubricator. Prior to detonation of the perforating guns 16 and 18, the wireline 12 can support the weight of the gun string 10 in the wellbore 14 (it will not snap or break).

The novel method of perforating, in accordance with one aspect of the present invention, is set forth as follows:

(1) The firing head is initiated, a detonation wave conducts in the detonating cord, and the detonation wave propagates through the interior of: the first part 16 only because the first part 16 is a perforating gun, the automatic release apparatus 20, and the second part 18;

(2) Before the perforating gun of the second part 18 detonates, in response to the detonation wave in the detonating cord, the automatic release apparatus 20 initiates the release of the second part 18 of the gun string from the first part 16 of the gun string 10;

(3) After initiation of the release of the second part 18 of the gun string 10 from the first part 16, but before the second part 18 of the gun string 10 has a chance to fall to a bottom of the wellbore 14, the perforating gun 18 of the second part will detonate; in addition, since, in FIG. 1, the first part 16 is a perforating gun, the perforating gun of the first part 16 will also detonate; the perforating gun(s) will perforate a formation traversed by the wellbore 14;

(4) After the first perforating gun 16 of the first part and the second perforating gun 18 of the second part has detonated, and after the second part 18 has been released from the first part 16, the perforating gun 18 of the second part of the gun string 10 will fall to a bottom of the wellbore; and (5) The first part 16 of the gun string 10 can now be retrieved from the wellbore 14 to a surface of the wellbore.

Since initiation of the release of the second part 18 of the gun string 10 from the first part 16 by the automatic release apparatus 20 occurred before the perforating gun of the second part 18 had a chance to detonate, the subsequent detonation of the perforating gun 18 of the second part 18 of the gun string 10 will not shock or break the wireline 12.

Figure 3:
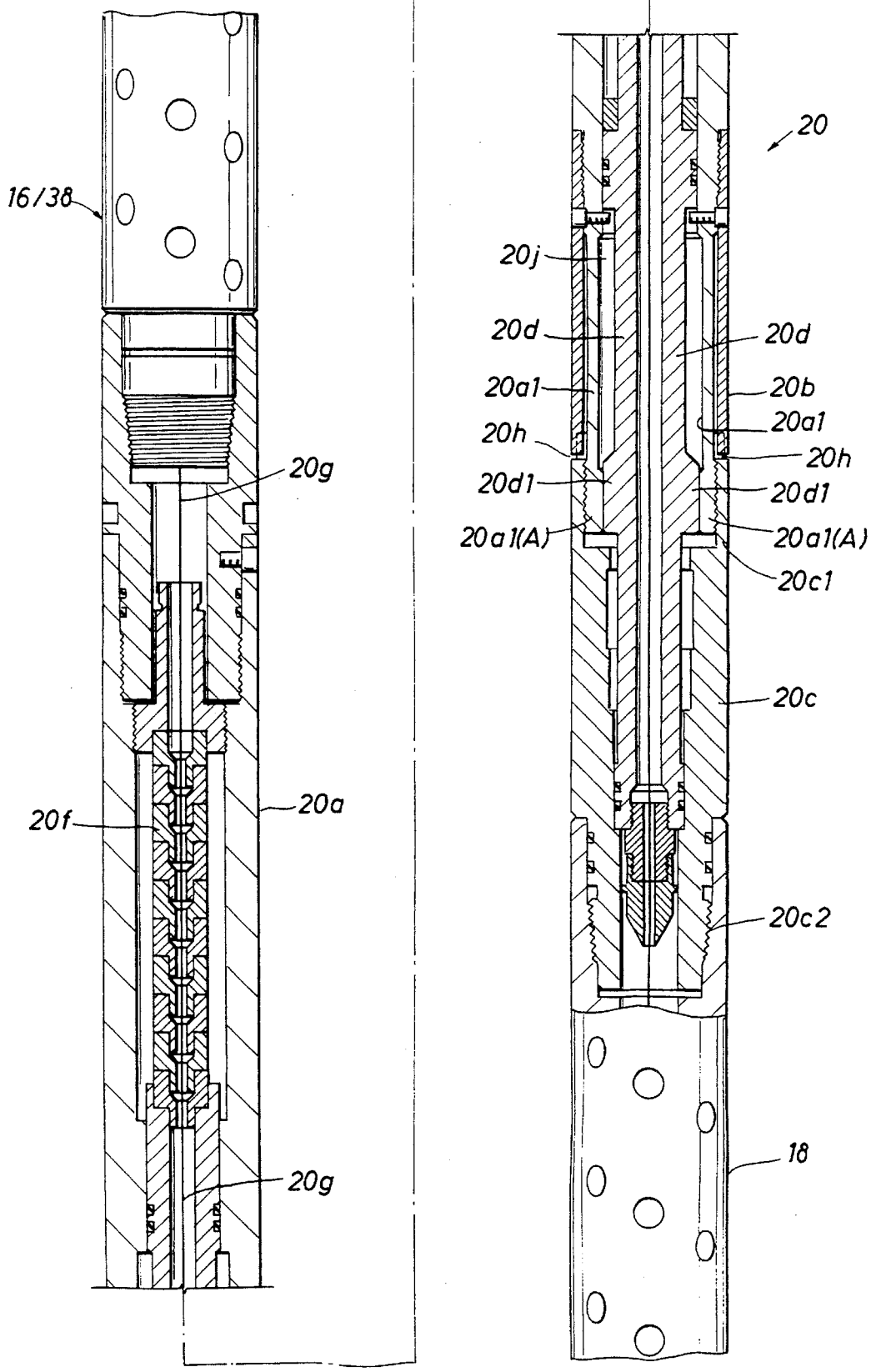
FIGS. 3–5 illustrate a more detailed construction of the novel automatic release apparatus of FIGS. 1–2 connected between two perforating guns (FIG. 3), between an exploding foil firing head and a perforating gun (FIG. 4), and between a coiled tubing firing head and a perforating gun (FIG. 5)

Referring to FIG. 3, a detailed construction of the automatic release apparatus 20 of FIGS. 1–2 is illustrated. In FIG. 3, the automatic release apparatus 20 is shown interconnected between the perforating gun of the first part 16 and the perforating gun of the second part 18 of the gun string 10 of FIG. 1.

In FIG. 3, the automatic release apparatus 20 comprises a release mandrel **20*a* and an anti-rotation collar 20*b* which represents "a first outer housing" of the release apparatus 20, and a drop off sub 20*c* which represents "a second outer housing" of the release apparatus 20. The drop off sub 20*c* includes a top threaded end 20*c*1 and a bottom threaded end 20*c*2. The bottom threaded end 20*c*2 is connected to the second part 18 of the gun string 10 of FIG. 1. The interior of the top threaded end 20*c*1 includes interior threads. The release mandrel 20*a* includes a collet finger 20*a*1 and the collet finger 20*a*1 includes a threaded end 20*a*1(A) having exterior threads which are adapted to mate with the interior threads on the top threaded end 20*c*1 of the drop off sub 20*c*. A release piston 20*d* is disposed within the release mandrel 20*a*, the anti-rotation collar 20*b* and the drop off sub 20*c* of the release apparatus 20. The release piston 20*d* is adapted to move longitudinally within the release apparatus 20. The release piston 20*d* includes an upset 20*d*1**.

When the release piston **20*d* is located in a particular longitudinal position within the release apparatus 20 as shown in FIG. 3, the upset 20*d*1 on the release piston 20*d* will hold the exterior threads on the threaded end 20*a*1(A) of the collet finger 20*a*1 firmly against the interior threads on the top threaded end 20*c*1 of the drop off sub 20*c*. As a result, the drop off sub 20*c* will not separate from the the release mandrel 20*a***. Stated differently, as long as the upset

20d1 on the release piston 20d holds the exterior threads on the threaded end 20a1(A) of the collet finger 20a1 firmly against the interior threads on the top threaded end 20c1 of the drop off sub 20c, the "second outer housing" of the release apparatus 20 (drop off sub 20c) will not be separated from the "first outer housing" (release mandrel 20a) of the release apparatus 20.

The release piston 20d is normally prevented from moving longitudinally within the release apparatus 20 by a frangible member 20f discussed below. Therefore, the upset 20d1 on the release piston 20d is normally prevented from moving longitudinally within the release apparatus 20. As a result, the threaded end 20a1(A) of the collet finger 20a1 is firmly held, by the release piston upset 20d1, against the top threaded end 20c1 of the drop off sub 20c.

The frangible member 20f, otherwise known as a break plug assembly 20f, is positioned in an end of the release piston 20d. As long as the frangible member 20f remains intact, the frangible member 20f will prevent the release piston 20d and its upset 20d1 from moving longitudinally within the release apparatus 20. The frangible member 20f, also known as the break plug assembly 20f, is comprised of a cast iron material. Cast iron also includes ductile iron. A detonating cord 20g is disposed within a hollow interior of the cast iron frangible member 20f, the detonating cord being adapted to conduct a detonation wave. The frangible member 20f will remain intact as long as a detonation wave does not propagate within the portion of the detonating cord 20g which is disposed within the hollow interior of the frangible member 20f. However, since the frangible member 20f is made of a cast iron material, in response to a detonation wave in the detonating cord 20g conducting within the hollow interior of the frangible member 20f, the cast iron material of the frangible member 20f will shatter into a multitude of pieces. When the frangible member 20f shatters, there is no longer any support provided to the release piston 20d. Therefore, when the frangible member 20f shatters, the release piston 20d and its upset 20d1 are both free to move longitudinally within the release apparatus 20 in response to wellbore fluid pressure.

The drop off sub 20c and the anti rotation collar 20b beth have a gap 20h disposed therethrough. The gap 20h provides fluid communication between an annulus of the wellbore and an interior 20j of the release apparatus 20 which is disposed adjacent the release piston 20d. When the frangible member 20f shatters, a wellbore pressure present within the annulus of the wellbore will fluidly communicate with the interior 20j of the release apparatus via the gap 20h. Since the interior 20j is disposed adjacent the release piston 20d, the wellbore fluid pressure which is entering the release apparatus from gap 20h will push against the release piston 20d, and the wellbore pressure will, in turn, tend to move the release piston 20d upwardly in FIG. 3. When the release piston 20d moves upwardly in FIG. 3, the upset 20d1 on the release piston 20d will move away from the threaded end 20a1(A) of the collet finger 20a1. Since the upset 20d1 no longer firmly holds the threaded end 20a1(A) of the collet finger 20a1 against the top threaded end 20c1 of the drop off sub 20c, the end 20a1(A) of the collet finger 20a1 is free to move away from the top threaded end 20c1 of the drop off sub 20c. When the end 20a1(A) of collet finger 20a1 moves away from the top threaded end 20c1 of the drop off sub 20c, the drop off sub 20c is now free to move away from the release mandrel 20a. In other words, the "second outer housing" of the release apparatus 20 is free to separate from the "first outer housing" of the release apparatus 20.

Figure 4:
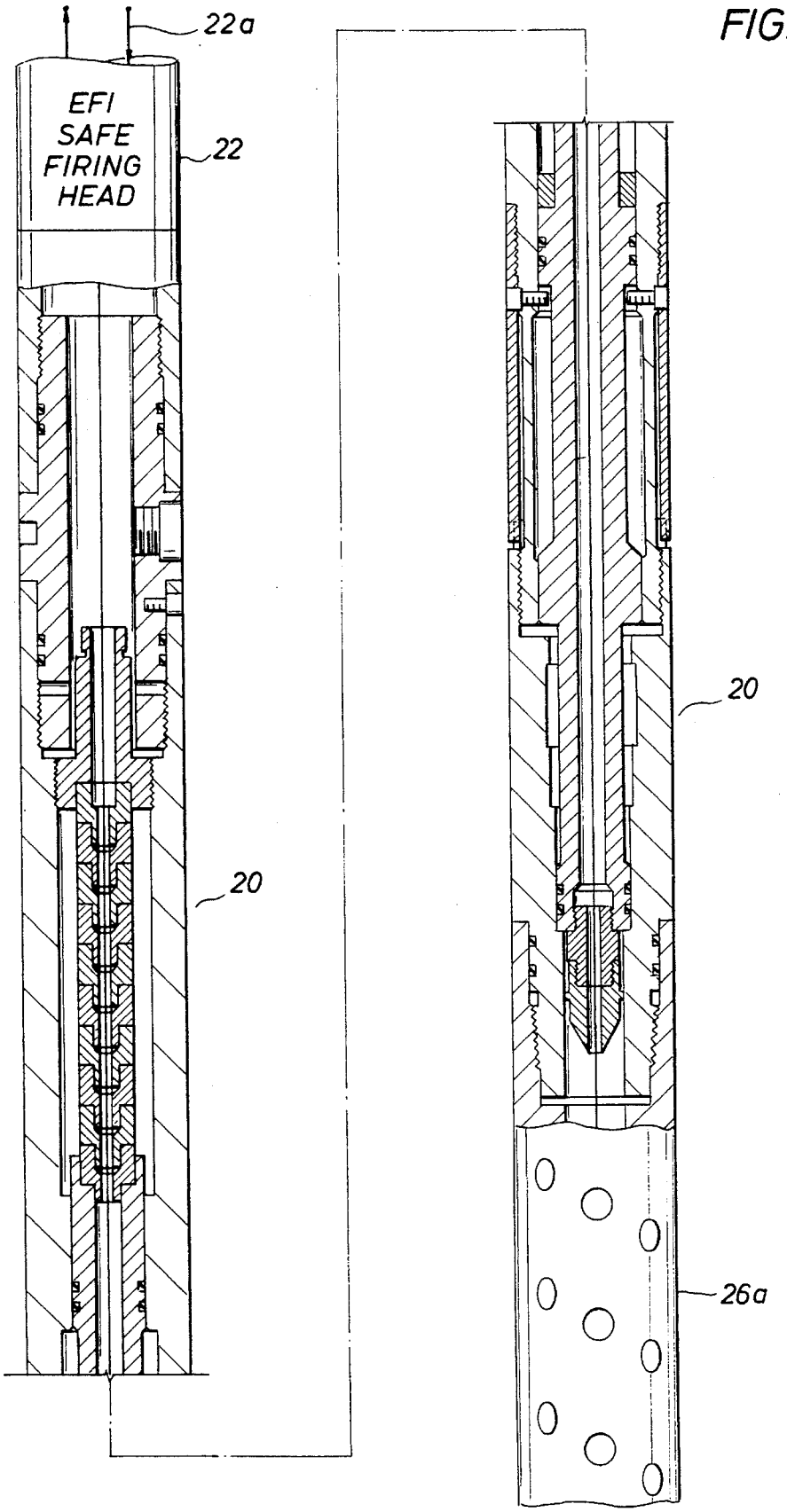
Figure 5:
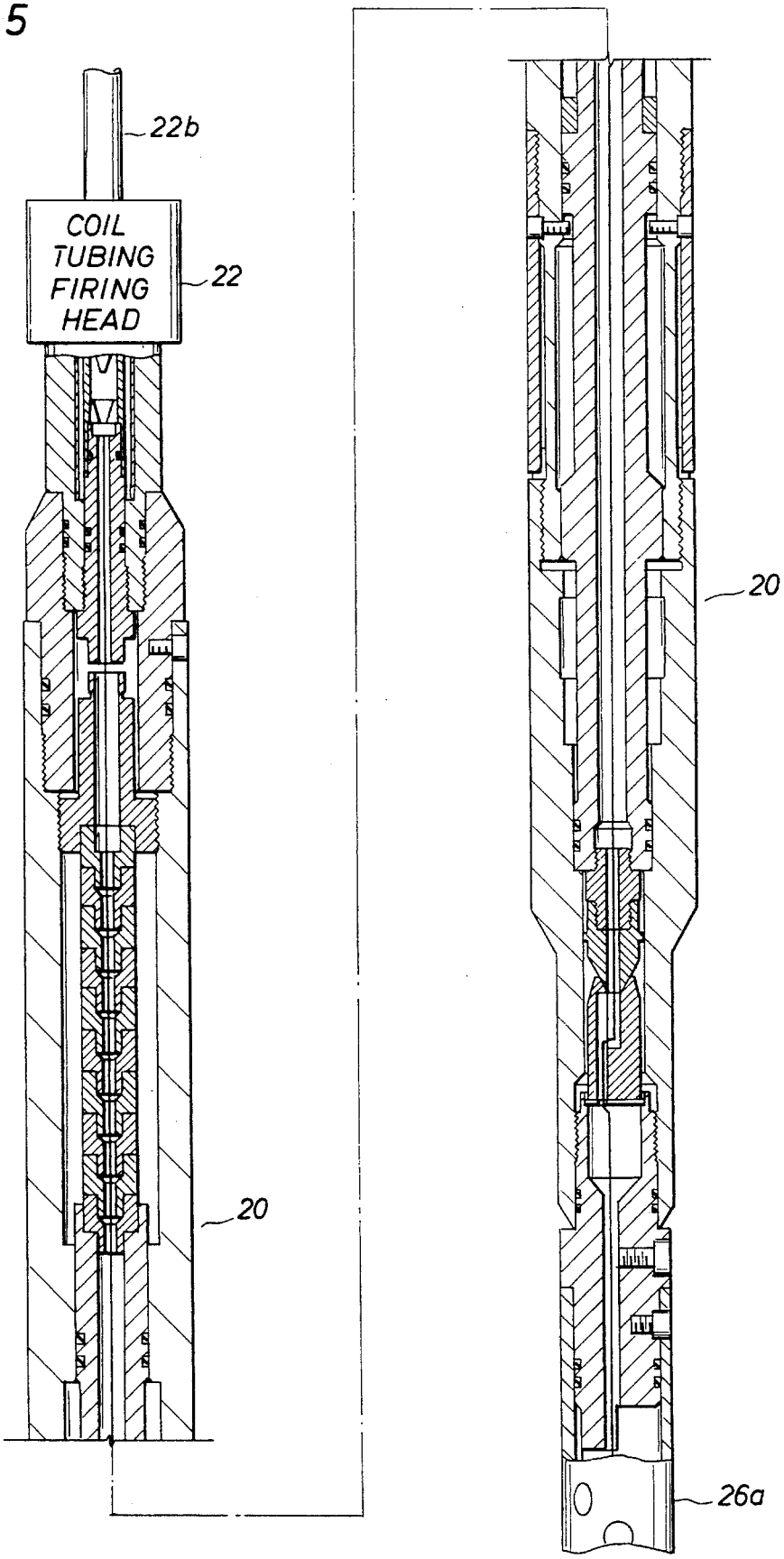

Referring to FIGS. 4 and 5, the same automatic release apparatus 20 which is discussed above with reference to FIG. 3 is now shown in FIGS. 4 and 5. However, in FIGS. 4–5, the automatic release apparatus 20 is now interconnected between the firing head 22 of FIG. 2, which comprises the first part 22 of the gun string 10 of FIG. 2, and the perforating gun 26a, which comprises a portion of the second part 26 of the gun string 10 of FIG. 2.

In FIG. 4, the firing head 22 is an Exploding Foil Initiator (EFI) firing head, which is electrically connected to two electrical current carrying conductors 22a, of the type disclosed in prior pending application Ser. No. 08/116,082, filed Sep. 1, 1993, now U.S. Pat. No. 5,347,929 to Lerche et al, entitled "Firing System For a Perforating Gun Including an Exploding Foil Initiator and an Outer Housing for Conducting Wireline Current and EFI Current", the disclosure of which is incorporated by reference into this specification.

In FIG. 5, the firing head 22 is a coiled tubing firing head, which is mechanically connected to a coiled tubing 22b, of the type disclosed in prior pending application corresponding to attorney docket number 22.1169, filed Jun. 7, 1994, to Huber et al, entitled "A Firing Head Connected Between a Coiled Tubing and a Perforating Gun Adapted to Move Freely within a Tubing String and Actuated by Fluid Pressure in the Coiled Tubing", the disclosure of which is incorporated by reference into this specification.

A functional description of the operation of the present invention will be set forth in the following paragraphs with reference to FIGS. 1, 6, and 7 of the drawings. The following functional description would also apply with reference to FIGS. 2, 6, and 7. However, for ease of description, reference is directed to FIGS. 1, 6, and 7.

Assume that the perforating gun string 10 of FIG. 1 is being lowered into the wellbore 14 by, for example, a wireline conveyor 12. When the gun string 10 is in place in wellbore 14, the firing head is initiated and a detonation wave is conducted within the detonating cord 20g of FIG. 6. When the detonation wave in detonating cord 20g passes through the interior of the frangible member 20f of FIG. 6, the frangible member 20f shatters into a multitude of pieces. The release of the second part 18 of the gun string 10 from the part part 16 has now been initiated. Wellbore pressure present within an annulus 14a of the wellbore 14 of FIG. 1 will enter gap 20h of FIG. 6. This wellbore pressure will force the release piston 20d upwardly in FIG. 6. A movement of the release piston 20d upwardly in FIG. 6 will also move the upset 20d1 on the release piston 20d upwardly in FIG. 6. When the upset 20d1 moves upwardly a sufficient amount, the end 20a1(A) of the collet finger 20a1 will begin to move away from the top threaded end 20c1 of the hop off sub 20c. When the end of the collet finger 20a1 moves away from the top end 20c1 of the drop off sub 20c, the hop off sub 20c (second outer housing of the automatic release apparatus 20) is physically disconnected from the release mandrel 20a and antirotation collar 20b (first outer housing of the release apparatus). Recall that the hop off sub 20c is connected to the perforating gun of the second part 18 of the gun string 10 of FIG. 1. Therefore, the second part 18 of the gun string of FIG. 1 is free to begin falling to a bottom of the wellbore 14. However, before the second part 18 of the gun string 10 of FIG. 1 has a chance to begin its fall to the bottom of the wellbore 14, the first perforating gun 16 of the first part 16 of the gun string 10 of FIG. 1 and the second perforating gun 18 of the second part 18 of the gun string 10 of FIG. 1 both detonate and perforate the formation traversed by the wellbore 14. After the detonation, since initiation of the release of the second perforating gun of the second part 18 from the first perforating gun of the first part 16 by the automatic release apparatus 20 has already occurred, the second perforating gun 18 begins its fall to a bottom of the wellbore 14 and the first perforating gun 16 is withdrawn to a surface of the wellbore 14. Since initiation of the release of the second perforating gun 18 of the second part 18 of gun string 10 from the first perforating gun 16 of the first part 16 of gun string 10 occurred before the second perforating gun 18 detonated, the detonation of the second perforating gun 18 in FIG. 1 will not snap and break the wireline conveyor 12. Since the gun string 10 in FIG. 1 has a length "L" which is greater than the length of a wellhead pressure lubricator, the gun string 10 of FIG. 1 has now perforated a "long length interval" of the wellbore 14 during a single perforating run into the wellbore, all while maintaining underbalance and without killing the well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of perforating a wellbore, comprising the steps of:

(a) suspending a gun string from a conveyor and lowering said conveyor and said gun string into said wellbore, said gun string including a first part, a second part including a perforating gun adapted to detonate, and a detonating cord adapted for conducting a detonation wave;

(b) conducting said detonation wave in said detonating cord;

(c) prior to the detonation of said perforating gun, initiating a release of said second part of said gun string from said first part of said gun string, the initiating step including the steps of, conducting said detonation wave in said detonating cord through a frangible member, and shattering said frangible member when said detonation wave passes through said frangible member;

(d) detonating said perforating gun; and (e) releasing said second part of said gun string from said first part of said gun string.

2. The method of claim 1, further comprising the steps of:

in response to the releasing step, dropping said second part of said gun string including said perforating gun to said bottom of said wellbore; and raising said first part of said gun string to a surface of said wellbore.

3. The method of claim 1, wherein said gun string further includes a release apparatus interconnected between said first part and said second part of said gun string, said release apparatus including a first outer housing and a second outer housing adapted to separate from said first outer housing, said frangible member being disposed within the outer housing, and said detonating cord disposed within the frangible member adapted for conducting said detonation wave through said frangible member, and wherein the releasing step (e) of releasing said second part of said gun string from said first part of said gun string comprises the steps of:

(f) separating said second outer housing of said release apparatus from said first outer housing of said release apparatus in response to the shattering of said frangible member; and (g) in response to the separating step (f), releasing said second part of said gun string from said first part of said gun string.

4. An automatic release apparatus adapted to be connected between a first part of a gun string and a second part of a gun string in a wellbore, comprising:

an outer housing including a first outer housing adapted to be connected to said first part of said gun string and a second outer housing adapted to be connected to said second part of said gun string, said second outer housing being adapted to separate from said first outer housing;

a frangible member having a hollow interior disposed within said outer housing;

a detonating cord adapted for conducting a detonation wave disposed within the hollow interior of said frangible member; and connection maintaining means supported by said frangible member for maintaining a connection between said first outer housing and said second outer housing, said detonation wave conducting in said detonating cord shattering said frangible member when said detonation wave conducts within the hollow interior of said frangible member, the connection maintaining means releasing said connection between said first outer housing and said second outer housing when said frangible member shatters, said first outer housing separating from said second outer housing when said connection maintaining means releases said connection between said first outer housing and said second outer housing.

5. The automatic release apparatus of claim 4, wherein said first outer housing includes a collet finger having an end, said second outer housing including a top threaded end, and wherein said connection maintaining means comprises:

a piston having an upset, said piston being supported in a particular position by said frangible member, said end of said collet finger of said first outer housing being disposed between said top threaded end of said second outer housing and said upset of said piston when said piston is supported by said frangible member in said particular position, said piston maintaining said connection between said first outer housing and said second outer housing when said upset of said piston urges said end of said collet finger of said first outer housing against said top threaded end of said second outer housing.

6. A method of operating a long tool suing in a wellbore where the tool string is longer than a wellhead lubricator, comprising the steps of:

(a) lowering the tool string into a wellbore, said tool string including a release apparatus, a first part connected to said release apparatus and located above the release apparatus when the tool suing is disposed in the wellbore, and a second part connected to said release apparatus and located below the release apparatus when the tool suing is disposed in the wellbore, said second part including a perforating gun, said first part including another perforating gun, said release apparatus including a frangible member;

(b) initiating activation of said release apparatus, the initiating step including the step of shattering said frangible member;

(c) initiating a disconnection of said second part from said first part of said tool string in response to the shattering step;

(d) detonating said perforating gun of said second pan and simultaneously completing the disconnection Of said perforating gun of said second part from said first part in response to the initiating step (c), and dropping said perforating gun into said wellbore in response to the completing step;

(e) detonating said another perforating gun of said first part; and (f) raising said another perforating gun of said first part to a surface of the wellbore while dropping said perforating gun of said second pan into said wellbore.

7. A release apparatus adapted to be connected between a first part of a tool string and a second part of a tool string in a wellbore, comprising:

an outer housing including a first outer housing adapted to be connected to said first part of said tool string and a second outer housing adapted to be connected to said second part of said tool string, said second outer housing being adapted to separate from said first outer housing;

a frangible member having a hollow interior disposed within said outer housing;

means for conducting a detonation wave disposed within the hollow interior of said frangible member; and connection maintaining means supported by said frangible member for maintaining a connection between said first outer housing and said second outer housing, said detonation wave conducting in said means for conducting shattering said frangible member when said detonation wave conducts within the hollow interior of said frangible member, the connection maintaining means releasing said connection between said first outer housing and said second outer housing when said frangible member shatters, said first outer housing separating from said second outer housing when said connection maintaining means releases said connection between said first outer housing and said second outer housing.

8. The release apparatus of claim 7, wherein said first outer housing includes a collet finger having an end, said second outer housing including a top threaded end, and wherein said connection maintaining means comprises:

a piston having an upset, said piston being supported in a particular position by said frangible member, said end of said collet finger of said first outer housing being disposed between said top threaded end of said second outer housing and said upset of said piston when said piston is supported by said frangible member in said particular position, said piston maintaining said connection between said first outer housing and said second outer housing when said upset of said piston urges said end of said collet finger of said first outer housing against said top threaded end of said second outer housing.

9. A method of perforating a long length interval of a formation penetrated by a wellbore where the long length interval is longer in length than a length of a wellhead lubricator, comprising the steps of:

connecting an apparatus to a conveyor and lowering said apparatus while suspending from said conveyor into said wellbore until said apparatus is adjacent said long length interval of said formation, said apparatus being longer in length than a length of a wellhead lubricator and including a first perforating gun, a second perforating gun, and a release apparatus connected between said first perforating gun and said second perforating gun;

detonating said first perforating gun, initiating activation of said release apparatus, and detonating said second perforating gun;

dropping said second perforating gun into said wellbore in response to the initiating step when the second perforating gun is detonated; and raising said first perforating gun to a surface of said wellbore in response to the initiating step when the first perforating gun is detonated.

10. The method of claim 9, wherein the initiating step includes the steps of conducting a detonation wave through an interior of a frangible member, and shattering the frangible member when the detonation wave conducts through said interior of said frangible member.

11. An apparatus adapted to be disposed in a wellbore, comprising:

a first part adapted to be connected to a conveyor, said first part including a perforating gun;

a second part, said second pan including a perforating gun; and a release apparatus interconnected between said first pan and said second part, said first part, said release apparatus, and said second pan suspending from said conveyor in said wellbore when said first pan is connected to said conveyor and said first pan, said release apparatus and said second part are lowered into said wellbore to a particular position in said wellbore, said first part, said release apparatus, and said second pan being disposed adjacent a long length interval of a formation penetrated by said wellbore when lowered to said particular position in said wellbore, said long length interval of said formation being longer in length than a length of a wellhead lubricator, said first part, said release apparatus, and said second pan having a length which is longer than said length of said wellhead lubricator.

12. The apparatus of claim 11, wherein said release apparatus is adapted to release said perforating gun of said second part from said perforating gun of said fast part and comprises a frangible member adapted to shatter and a detonating cord adapted for conducting a detonation wave disposed within said frangible member, said frangible member shattering when said detonation wave conducting is said detonating cord passes through an interior of said frangible member, said perforating gun of said second part being released from said perforating gun of said first part when said frangible member shatters.

* * * * *

UNITED STATES PATENT AND TRADEMARK OFFICE

CERTIFICATE OF CORRECTION

PATENT NO. : 5,509,481

DATED : April 23, 1996

INVENTOR(S) : Klaus B. Huber, et. al.

It is certified that error appears in the above-indentified patent and that said Letters Patent is hereby corrected as shown below:

Title page, item [57], Abstract:
line 7, delete "suing" and insert --string--.
line 10, delete "suing" and insert --string--.
line 14, delete "swing" and insert --string--.
line 15, delete "suing" and insert --string--.
line 19, delete "suing" and insert --string--.

Col. 12, line 46, delete "suing" and insert --string--.
Col. 12, line 52, delete "suing" and insert --string--.
Col. 12, line 55, delete "suing" and insert --string--.
Col. 12, line 66, delete "pan" and insert -- part--.
Col. 12, line 67, delete "Of" and insert --of--.
Col. 13, line 9, delete "pan" and insert --part--.
Col. 14, line 27, delete "pan" and insert --part--.
Col. 14, line 29, delete "pan" and insert --part--.
Col. 14, line 31, delete "pan" and insert --part--.
Col. 14, line 34, delete "pan" and insert --part--.
Col. 14, line 35, delete "pan" and insert --part--.
Col. 14, line 38, delete "pan" and insert --part--.
Col. 14, line 45, delete "pan" and insert --part--.
Col. 14, line 50, delete "fast" and insert --first--.

UNITED STATES PATENT AND TRADEMARK OFFICE

CERTIFICATE OF CORRECTION

PATENT NO. : 5,509,481

DATED : April 23, 1996

INVENTOR(S) : Klaus B. Huber, et. al.

It is certified that error appears in the above-indentified patent and that said Letters Patent is hereby corrected as shown below:

Col. 14, line 55, delete "is" and insert --in--.

Signed and Sealed this

Twenty-eighth Day of January, 1997

*Attest:*

Bruce Lehman

BRUCE LEHMAN

*Attesting Officer*

*Commissioner of Patents and Trademarks*